US009174479B2

(12) United States Patent
Nagoshi et al.

(10) Patent No.: US 9,174,479 B2
(45) Date of Patent: Nov. 3, 2015

(54) COATED PRINTING PAPER AND METHOD FOR FORMING PRINTED IMAGES

(75) Inventors: Masanori Nagoshi, Tokyo (JP); Kazutoshi Iida, Tokyo (JP); Koji Idei, Tokyo (JP); Toru Kaneko, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 278 days.

(21) Appl. No.: 13/876,512

(22) PCT Filed: Sep. 21, 2011

(86) PCT No.: PCT/JP2011/071448

§ 371 (c)(1), (2), (4) Date: Mar. 28, 2013

(87) PCT Pub. No.: WO2012/043323

PCT Pub. Date: Apr. 5, 2012

(65) Prior Publication Data

US 2013/0176371 A1 Jul. 11, 2013

(30) Foreign Application Priority Data

| | | |
|---|---|---|
| Sep. 29, 2010 | (JP) | 2010-218820 |
| Sep. 30, 2010 | (JP) | 2010-221308 |
| Sep. 30, 2010 | (JP) | 2010-221309 |
| Sep. 30, 2010 | (JP) | 2010-221310 |
| Sep. 30, 2010 | (JP) | 2010-221311 |

(51) Int. Cl.

| | |
|---|---|
| ***B41J 2/01*** | (2006.01) |
| ***B41M 5/50*** | (2006.01) |
| ***D21H 19/44*** | (2006.01) |
| ***B41M 5/52*** | (2006.01) |
| *B41M 5/00* | (2006.01) |

(52) U.S. Cl.

CPC ... *B41M 5/50* (2013.01); *B41J 2/01* (2013.01); *B41M 5/5218* (2013.01); *D21H 19/44* (2013.01); *B41M 5/0035* (2013.01); *Y10T 428/31971* (2015.04); *Y10T 428/31993* (2015.04)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 11/002; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218

USPC ..... 347/100, 95, 105, 101, 96, 103, 102; 428/32.1, 195; 106/31.6, 31.27, 31.13

See application file for complete search history.

(56) References Cited

U.S. PATENT DOCUMENTS

| | | | | |
|---|---|---|---|---|
| 6,350,507 | B1 | 2/2002 | Iwamoto et al. | |
| 6,977,100 | B2 * | 12/2005 | Kondo et al. | 347/105 |
| 2003/0227531 | A1 * | 12/2003 | Hosoi et al. | 347/105 |
| 2005/0162495 | A1 * | 7/2005 | Wexler | 347/105 |
| 2009/0213151 | A1 * | 8/2009 | Dannhauser et al. | 347/9 |

FOREIGN PATENT DOCUMENTS

| | | | |
|---|---|---|---|
| JP | 3-43290 | A | 2/1991 |
| JP | 5-254239 | A | 10/1993 |
| JP | 11-321090 | A | 11/1999 |
| JP | 2004-276420 | A | 10/2004 |
| JP | 2005-161601 | A | 6/2005 |
| JP | 2008-114543 | A | 5/2008 |
| JP | 2008-297679 | A | 12/2008 |
| JP | 2009-023292 | A | 2/2009 |
| JP | 2009-138317 | A | 6/2009 |
| JP | 2010-100039 | A | 5/2010 |

* cited by examiner

*Primary Examiner* — Manish S Shah

(74) *Attorney, Agent, or Firm* — Birch, Stewart, Kolasch & Birch, LLP.

(57) ABSTRACT

The invention provides coated printing paper having base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the base paper and/or the coating layer contains a calcium compound other than calcium carbonate, and the content of calcium derived from the calcium compound is 3 mmol to 60 mmol, both inclusive, in terms of calcium ions per 1 $m^2$ of the base paper and/or the coating layer.

15 Claims, No Drawings

COATED PRINTING PAPER AND METHOD FOR FORMING PRINTED IMAGES

TECHNICAL FIELD

The present invention relates to coated printing paper. The invention also relates to a method for forming printed images on coated printing paper.

BACKGROUND ART

The rapid progress of ink jet recording technology has made it possible to form high-quality colored images on recording media such as paper and films with printers utilizing the ink jet recording technology (hereinafter, referred to as "ink jet printers"). Such ink jet printers range from small home printers to large format printers. Because these printers basically perform printing on a single sheet basis, they have been mainly utilized at printing worksites handling small numbers of copies. The printing speed of large format printers is several meters or less per minute, although variable depending on the printing size or the image quality.

As a result of further progress in the technology, ink jet recording has recently become used in industrial printing (hereinafter, referred to as "ink jet printing"). Because large numbers of copies are printed in the industrial printing field, printing speed is important due to the productivity and the printing costs. A printing speed suitable for ink jet printing is achieved with a printing machine that is equipped with a line head in which ink-ejecting heads are fixed in the entirety of the width direction perpendicular to the paper transport direction (hereinafter, such a printing machine will be referred to as "ink jet printing machine") (see, for example, Patent Literature 1). More recently, rotary ink jet printing machines using pigment inks have been developed which have a printing speed of 15 m/min or more, a higher speed of 60 m/min or more, and a still higher speed in excess of 120 m/min.

Because ink jet printing machines allow for handling of variable information, their use is particularly found in on-demand printing. A preferred manner of industrial printing is to print fixed information with an offset printing machine and to print variable information with an ink jet printing machine.

However, poor fixation and absorption of ink jet inks are encountered when conventional coated offset printing paper is used in printing with an ink jet printing machine at such a printing speed as described above. As a result, the printed image is smeared by abrasion caused during post-printing handling. Further, because the absorption of inks is insufficient, printing at the above printing speed results in problems such as the occurrence of uneven printing, blurred printing and, in the worst cases, ink bleeding (a phenomenon in which an ink that has remained unabsorbed bleeds on the coated paper).

Ink fixing properties and ink absorption properties during ink jet printing may be improved by simply reducing the amount of a binder in a coating layer or by adding a large amount of a porous pigment to a coating layer. However, such approaches result in the occurrence of problems such as blanket piling to cause a decrease in the coating strength of the coating layer, thereby deteriorating the offset printability of the coated printing paper.

From the viewpoint of weather resistance, ink jet printing machines tend to be configured to be loaded with ink jet pigment inks. Problems encountered with pigment inks include uneven printing in printed sections. Uneven printing is a phenomenon in which coated printing paper exhibits a nonuniform density of an ink fixed in the printed image after the ink is dried to cause uneven ink absorption properties during high speed printing. Because inks used in ink jet printing have a low concentration of color material, uneven printing tends to be more marked than in offset printing. The presence of uneven printing deteriorates the commercial value of prints.

Exclusive paper for ink jet recording in which base paper is coated with a porous pigment having a high BET specific surface area (see, for example, Patent Literatures 2 and 3) exhibits excellent ink fixing properties and ink absorption properties during ink jet printing. However, such ink jet recording exclusive paper is poor in offset printability due to insufficient strength of the coating layer.

Further, ink jet recording exclusive paper which suppresses the occurrence of uneven printing in printed images has been developed. Such recording media are ink jet recording sheets which include support paper containing a water-soluble metal salt, and an ink receiving layer containing a protein on the support paper (see, for example, Patent Literature 4); ink jet recording paper which has an ink receiving layer and a gloss layer on a support wherein the gloss layer contains 5 to 30 wt % of a chloride of a Group 2A element in the periodic table (see, for example, Patent Literature 5); and ink jet recording paper which has an ink receiving layer and a gloss layer on a substrate and is further provided with an overcoating layer containing a multivalent metal salt and a penetrating agent (see, for example, Patent Literature 6). However, these types of ink jet recording exclusive paper are dedicated to ink jet printers. Thus, they are poorly suitable for offset printing, and cannot suppress the occurrence of uneven printing to a sufficiently satisfactory level when used for ink jet printing machines. Other types of ink jet recording paper have been disclosed in which base paper containing a cationic polymer is coated with a coating layer based on an inorganic pigment and a binder (see, for example, Patent Literature 7). Such recording paper exhibits good offset printability but is often rather unsatisfactory in terms of uneven printing when used for ink jet printing machines.

CITATION LIST

Patent Literature

Patent Literature 1: Japanese Patent Application Kokai Publication No. 2009-23292

Patent Literature 2: Japanese Patent Application Kokai Publication No. H3-43290

Patent Literature 3: Japanese Patent Application Kokai Publication No. H5-254239

Patent Literature 4: Japanese Patent Application Kokai Publication No. 2004-276420

Patent Literature 5: Japanese Patent Application Kokai Publication No. 2005-161601

Patent Literature 6: Japanese Patent Application Kokai Publication No. 2008-114543

Patent Literature 7: Japanese Patent Application Kokai Publication No. 2010-100039

SUMMARY OF INVENTION

Technical Problem

Existing coated printing paper does not satisfy ink jet printability without any deterioration in offset printability. In particular, no coated printing paper has been developed which exhibits suitability for an ink jet printing machine using pigment inks while maintaining offset printability.

A first object of the invention is that coated printing paper satisfies the following requirements: (1) to have good offset printability, (2) to exhibit sufficient ink fixing properties and ink absorption properties in ink jet printing, and (3) to sufficiently suppress the occurrence of uneven printing in printed sections during printing with an ink jet printing machine using pigment inks.

A second object of the invention is to provide a method which can form printed images without the occurrence of uneven printing even when pigment inks are used for ink jet printing at a printing speed of 15 m/min or more. A further object is to provide a method for forming excellent printed images using an offset printing machine and/or an ink jet printing machine.

Solution to Problem

The invention provides coated printing paper comprising base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the base paper and/or the coating layer contains a calcium compound other than calcium carbonate, and the content of calcium derived from the calcium compound is 3 mmol to 60 mmol, both inclusive, in terms of calcium ions per 1 $m^2$ of the base paper and/or the coating layer. Such coated printing paper satisfies the first object, namely, has good offset printability and exhibits good ink fixing properties and ink absorption properties in ink jet printing. In particular, this coated printing paper can suppress the occurrence of uneven printing in printed sections even when used for an ink jet printing machine using pigment inks. Thus, the inventive coated printing paper may be suitably used in industrial printing where fixed information is printed with an offset printing machine and variable information is printed with an ink jet printing machine.

A first aspect of the invention is directed to coated printing paper which comprises base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the base paper contains a calcium compound other than calcium carbonate, and the content of calcium derived from the calcium compound is 3 mmol to 60 mmol, both inclusive, in terms of calcium ions per 1 $m^2$ of the base paper. Such coated printing paper satisfies the first object, namely, has good offset printability and exhibits good ink fixing properties and ink absorption properties in ink jet printing. In particular, this coated printing paper can suppress the occurrence of uneven printing in printed sections even when used for an ink jet printing machine using pigment inks. Thus, the inventive coated printing paper may be suitably used in industrial printing where fixed information is printed with an offset printing machine and variable information is printed with an ink jet printing machine.

A second aspect of the invention is directed to coated printing paper which comprises base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the coating layer contains a calcium compound other than calcium carbonate, and the content of calcium derived from the calcium compound is 3 mmol to 60 mmol, both inclusive, in terms of calcium ions per 1 $m^2$ of the coating layer. Such coated printing paper satisfies the first object, namely, has good offset printability and exhibits good ink fixing properties and ink absorption properties in ink jet printing. In particular, this coated printing paper can suppress the occurrence of uneven printing in printed sections even when used for an ink jet printing machine using pigment inks. Thus, the inventive coated printing paper may be suitably used in industrial printing where fixed information is printed with an offset printing machine and variable information is printed with an ink jet printing machine.

According to a third aspect, the invention further provides a printing method using an ink jet printing machine which comprises ink jet printing using a pigment ink on the coating layer of the above coated printing paper at a printing speed of 15 m/min or more to form a printed image. According to this method, the second object can be satisfied. That is, printed images can be formed without the occurrence of uneven printing even when pigment inks are used for ink jet printing at a printing speed of 15 m/min or more.

According to a fourth aspect of the invention, the invention provides a method for forming printed images which includes operating an offset printing machine and/or an ink jet printing machine with respect to the coating layer of the above coated printing paper. According to this method, the third object can be satisfied. That is, excellent printed images can be formed using an offset printing machine and/or an ink jet printing machine.

EMBODIMENTS FOR CARRYING OUT THE INVENTION

As used herein, the term "ink jet printing machine" refers to an industrial printing machine that is used in industrial printing utilizing the ink jet recording technique. For example, such a printing machine is an ink jet printing machine having a printing speed of 15 m/min or more, a higher speed of 60 m/min or more, and a still higher speed in excess of 120 m/min, or a rotary ink jet printing machine using pigment inks. As used herein, the term "ink jet printing machine" is distinguished from ink jet recording printers having a printing speed of several meters per minute such as small home printers and large format printers (hereinafter, such printers will be referred to as "ink jet printers"). As used herein, the term "ink jet printing" refers to industrial printing based on the ink jet recording technique using an ink jet printing machine.

Offset printing is an indirect printing technique in which an ink is transferred first to a blanket and then to a workpiece. To have good offset printability means that no problems such as blanket piling are found after offset printing.

Uneven printing is a phenomenon in which coated printing paper exhibits a nonuniform density of an ink fixed in the printed image after the ink is dried to cause uneven ink absorption properties during high speed printing.

Hereinbelow, the coated printing paper of the invention will be described in detail.

The coated printing paper of the present invention includes base paper and, on at least one surface of the base paper, a coating layer containing a pigment and a binder as main components. The base paper contains calcium carbonate.

The base paper used in the coated printing paper of the present invention may be produced by acid, acid-free or alkaline papermaking of a paper stock which includes pulp, for example, chemical pulp such as LBKP (Leaf Bleached Kraft Pulp) or NBKP (Needle Bleached Kraft Pulp), mechanical pulp such as GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp) or CGP (ChemiGroundwood Pulp), or waste paper pulp such as DIP (DeInked Pulp), and calcium carbonate as an essential filler, as well as optional additives such as sizing agents, fixing agents, retention aids, cationizing compounds and paper strengthening additives.

Calcium carbonate is classified into ground calcium carbonate and precipitated calcium carbonate. The calcium carbonate used in the base paper of the present invention may be ground calcium carbonate, precipitated calcium carbonate or both in combination. The presence of calcium carbonate in the base paper ensures that good offset printability is obtained and the occurrence of uneven printing is suppressed favorably. Other fillers such as talc, clay and kaolin may be used in combination.

In the first aspect of the present invention, the base paper contains a calcium compound other than calcium carbonate (hereinafter, also simply referred to as calcium compound). The content of calcium derived from this calcium compound is 3 mmol to 60 mmol, both inclusive, in terms of calcium ions per 1 $m^2$ of the base paper.

As used herein, the calcium compound other than calcium carbonate is a water-soluble calcium compound, and is preferably a water-soluble calcium compound which can be dissolved in 20° C. water at 1 mass % or more. Examples of the water-soluble calcium compounds include salt compounds such as calcium lactate, calcium nitrate, calcium chloride, calcium formate and calcium acetate, and complex compounds such as calcium ethylenediamine tetraacetate. These compounds may be used singly, or two or more of them may be used in combination. In a preferred embodiment of the present invention, the calcium compound is calcium chloride. Calcium chloride is highly effective for the suppression of the occurrence of uneven printing during ink jet printing probably because of its high moisture absorptivity.

Water-soluble multivalent metal salts such as those described in Japanese Patent Application Kokai Publication No. 2007-268926 are known to be used in a coating layer of ink jet recording exclusive paper. Inks loaded in ink jet printing machines have low concentrations of color materials, and therefore such color materials tend to show mobility until they are fixed. In general, inks for ink jet printers are anionic. When a coating layer contains a multivalent metal salt, inks are fixed by multivalent metal cations released from the multivalent metal salt. Of water-soluble multivalent metal salts, water-soluble calcium compounds are difficult to use because they form calcium ions when dissolved in an aqueous solution and such calcium ions easily form poorly water-soluble salts such as calcium hydroxide and calcium carbonate. However, the present inventors have found that the occurrence of uneven printing during ink jet printing can be suppressed by adding a calcium compound to base paper of coated printing paper which includes the base paper and a coating layer both containing calcium carbonate. The reason why the suppression becomes possible is unknown but is probably because, in view of the fact that uneven printing is ascribed to nonuniform ink fixation and nonuniform speeds of ink absorption, a calcium compound provides ink fixation as described above and further microscopically forms a poorly water-soluble calcium salt on the surface of calcium carbonate in an area exhibiting low ink absorption properties, and such a poorly water-soluble calcium salt allows a capillary phenomenon to occur. Thus, it is necessary that the base paper and the coating layer contain calcium carbonate. Such effects are not obtained with other metal ions of multivalent metal salts.

In the present aspect, the content of calcium derived from the calcium compound other than calcium carbonate is 3 mmol to 60 mmol, both inclusive, in terms of calcium ions per 1 $m^2$ of the base paper. If the content is less than this range, suppressive effects for the occurrence of uneven printing in printed sections cannot be obtained. Any content greater than this range may cause the occurrence of uneven printing in printed sections. The content is more preferably 6 mmol to 55 mmol, both inclusive, and more preferably 8 mmol to 50 mmol, both inclusive.

The calcium compound other than calcium carbonate may be incorporated into the base paper by, for example, adding the calcium compound to the paper stock of the base paper and thereafter making the paper stock into the base paper, or by applying the calcium compound to the base paper or impregnating the base paper with the calcium compound. The application may be performed with any of various coaters such as size presses, film presses, gate roll coaters, film transfer coaters, blade coaters, rod coaters, air knife coaters and curtain coaters. From the viewpoint of production costs, it is preferable that the calcium compound be applied on-machine with a coater such as a size press, a gate roll coater or a film transfer coater installed on the papermaking machine.

In the present invention, the paper stock for the base paper may appropriately contain other additives such as dispersants, thickening agents, fluidity improving agents, defoamers, antifoamers, releasing agents, foaming agents, penetrating agents, coloring dyes, coloring pigments, optical brighteners, ultraviolet absorbers, antioxidants, preservatives, fungicides, insolubilizers, wet paper strengthening additives and dry paper strengthening additives while still achieving the desired effects of the present invention.

In the present invention, the sizing degree of the base paper may be any sizing degree as long as the desired effects of the invention are achieved. The sizing degree may be controlled by controlling the amount of an internal sizing agent or the amount of a surface sizing agent applied onto the base paper. Examples of the internal sizing agents include rosin sizing agents for acid paper, and alkenyl succinic acid anhydrides, alkyl ketene dimers, neutral rosin sizing agents and cationic styrene-acrylic sizing agents for alkaline paper. Examples of the surface sizing agents include styrene-acrylic sizing agents, olefin sizing agents and styrene-maleic sizing agents. In particular, a cationic or nonionic surface sizing agent is preferable when the sizing agent is applied together with any cationic compound.

From the viewpoint of absorptivity of ink jet inks, the ash content in the base paper is preferably 8 mass % to 25 mass %, both inclusive. This ash content ensures that offset printability and ink absorption properties during ink jet printing are further improved. The ash content in the base paper is more preferably 10 mass % to 20 mass %, both inclusive.

In the present invention, the ash content is a ratio (mass %) of the mass of incombustibles remaining after the base paper undergoes a combustion treatment at 500° C. for 1 hour to the absolute dry mass of the base paper before the combustion treatment. The ash content may be controlled by controlling the content of components such as filler in the base paper.

In the present invention, the thickness of the base paper is not particularly limited. The thickness of the base paper is preferably 50 μm to 300 μm, both inclusive, and more preferably 80 μm to 250 μm, both inclusive.

The coated printing paper of the present invention has, on the base paper, a coating layer which contains a pigment and a binder as main components. The coating layer allows the printing paper to be distinguished from high-quality paper in terms of printing quality and appearance.

Porous pigments such as synthetic silica used in a coating layer of ink jet recording exclusive paper can absorb ink jet inks. In contrast, kaolin and calcium carbonate which are used in a coating layer of general coated printing paper hardly absorb ink jet inks because particles thereof do not have porosity.

In the present invention, the coating layer contains ground calcium carbonate as a pigment. As described above, ground calcium carbonate is a type of calcium carbonate. The content of ground calcium carbonate in the coating layer is 50 parts by mass or more, and preferably 60 parts by mass or more relative to 100 parts by mass of the total of the pigment(s) in the coating layer. Although particles of ground calcium carbonate themselves do not have a capability of absorbing ink jet inks, ink jet inks may be absorbed by voids which are formed between the particles because of the ground calcium carbonate particles being amorphous. When the heavy calcium carbonate in the coating layer represents 50 parts by mass or more relative to 100 parts by mass of the total of the pigment(s) in the coating layer, the obtainable coated printing paper can achieve ink jet printability without being deteriorated in offset printability. The reason for this effect is unknown, but is probably because amorphous ground calcium carbonate forms a relatively large number of voids compared to regular particles. If the content of ground calcium carbonate in the coating layer is less than 50 parts by mass, the formation of voids in the coating layer becomes insufficient and ink jet printability cannot be obtained.

In the coating layer of the present invention, known pigments may be used in combination with the ground calcium carbonate. Examples of such pigments include inorganic pigments such as kaolin, precipitated calcium carbonate, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate and magnesium hydroxide; and organic pigments such as styrenic plastic pigments, acrylic plastic pigments, styrene-acrylic plastic pigments, polyethylene, microcapsules, urea resins and melamine resins.

The strength of the coating layer may be lowered when a porous pigment having high oil absorbency such as synthetic amorphous silica is used in a large amount. A decrease in the strength of the coating layer leads to troubles such as the occurrence of blanket piling during offset printing. Thus, the average oil absorption of the pigment(s) used in the coating layer is preferably 100 ml/100 g or less.

In the second aspect of the present invention, the coating layer contains a calcium compound other than calcium carbonate. The content of calcium derived from the calcium compound is 3 mmol to 60 mmol, both inclusive, in terms of calcium ions per 1 $m^2$ of the coating layer. Similarly to the first aspect, the calcium compound other than calcium carbonate is a water-soluble calcium compound, and is preferably a water-soluble calcium compound which can be dissolved in 20° C. water at 1 mass % or more. Examples of the water-soluble calcium compounds include salt compounds such as calcium lactate, calcium nitrate, calcium chloride, calcium formate and calcium acetate, and complex compounds such as calcium ethylenediamine tetraacetate. These compounds may be used singly, or two or more of them may be used in combination. In a preferred embodiment of the present invention, the calcium compound is calcium chloride. Calcium chloride is highly effective for the suppression of the occurrence of uneven printing during ink jet printing probably because of its high moisture absorptivity.

According to the finding by the present inventors, coated printing paper which includes base paper and a coating layer both containing calcium carbonate can suppress the occurrence of uneven printing during ink jet printing when the coating layer further contains such a calcium compound. The reason why the suppression becomes possible is unknown, but is probably because, in view of the fact that uneven printing is ascribed to nonuniform ink fixation and nonuniform speeds of ink absorption, a calcium compound provides ink fixation as described above and further microscopically forms a poorly water-soluble calcium salt on the surface of calcium carbonate in an area exhibiting low ink absorption properties, and such a poorly water-soluble calcium salt allows a capillary phenomenon to occur. Thus, it is necessary that the base paper and the coating layer contain calcium carbonate. Such effects are not obtained with other metal ions of multivalent metal salts.

In the present aspect, the content of calcium derived from the calcium compound other than calcium carbonate is 3 mmol to 60 mmol, both inclusive, in terms of calcium ions per 1 $m^2$ of the coating layer. If the content is less than this range, sufficient ink fixing properties and suppressive effects for the occurrence of uneven printing in printed sections cannot be obtained. Any content larger than the above range does not provide correspondingly greater effects in the improvement of ink fixing properties and for the suppression of the occurrence of uneven printing in printed sections, and rather can cause a decrease in ink absorption properties of the coated printing paper. The content is more preferably 3 mmol to 50 mmol, both inclusive, and more preferably 5 mmol to 45 mmol, both inclusive.

In the present invention, the content of calcium in terms of calcium ions derived from the calcium compound other than calcium carbonate present in the base paper or the coating layer (also referred to as "calcium content B" in the specification) may be determined by separating the coated printing paper into the base paper and the coating layer (or separate coating layers in the case of double-side coated paper), pulverizing and soaking in ultrapure water each of these elements, extracting calcium ions with an ultrasonic washing machine, and quantitatively determining the extracted calcium ions. The content of calcium in terms of calcium ions derived from calcium carbonate (also referred to as "calcium content A" in the specification) may be determined by separating the coated printing paper into the base paper and the coating layer, pulverizing each of these elements, determining the amount of calcium ions eluted from each element into a 0.1 N nitric acid solution, and subtracting the calcium content B of calcium ions eluted into ultrapure water from the determined amount of calcium ions. The amount of calcium ions may be measured by a known quantitative analysis method.

In a preferred embodiment of the present invention, the molar ratio (A/B) is 1 to 50, both inclusive, and more preferably 5 to 30, both inclusive, wherein A is the calcium content A derived from calcium carbonate and B is the calcium content B derived from the calcium compound other than calcium carbonate both in terms of calcium ions per 1 $m^2$ of the coated printing paper. By controlling the molar ratio to fall in this range, it is possible to further enhance the effects in the improvements of ink fixing properties and ink absorption properties as well as for the suppression of the occurrence of uneven printing in printed sections.

In the present invention, the coating weight of the coating layer in the coated printing paper is not particularly limited. From the viewpoints of the appearance and the ink fixing properties of the coated printing paper, it is preferable that the coating weight be 2.0 $g/m^2$ to 25.0 $g/m^2$, both inclusive, per surface. In the present invention, the coating weight of the coating layer indicates the coating weight on a dry solid basis.

To increase the gloss of the coated printing paper of the present invention, a plastic pigment that is highly capable of giving a gloss may be appropriately added to the coating layer to control the gloss. Further, the glossiness of the coated printing paper of the present invention may be increased by calendering. Exemplary calendering devices include on-line machine calender, super calender and soft nip calender. Alternatively, a known cast coating method may be used to give a gloss.

The coating layer of the present invention contains the pigment(s) and a binder as main components. In the present invention, the coating layer contains a known water-dispersible binder and/or a known water-soluble binder as the binder(s). Examples of the water-dispersible binders include conjugated diene copolymer latexes such as styrene-butadiene copolymer and acrylonitrile-butadiene copolymer; acrylic copolymer latexes such as polymers of acrylates or methacrylates, and methyl methacrylate-butadiene copolymer; vinyl copolymer latexes such as ethylene-vinyl acetate copolymer and vinyl chloride-vinyl acetate copolymer; polyurethane resin latexes; alkyd resin latexes; unsaturated polyester resin latexes; functionally modified copolymer latexes in which these various copolymers have been modified with monomers containing a functional group such as a carboxyl group; and thermosetting synthetic resins such as melamine resins and urea resins. Examples of the water-soluble binders include starch derivatives such as starch phosphates, starch ethers and starch phosphates; cellulose derivatives such as methylcellulose, carboxymethylcellulose and hydroxyethylcellulose; polyvinyl alcohol derivatives such as polyvinyl alcohol and silanol-modified polyvinyl alcohol; natural polymer resins such as casein, gelatin, modified products thereof, soy protein, pullulan, gum arabic, karaya gum, albumin and derivatives thereof; vinyl polymers such as sodium polyacrylate, polyacrylamide and polyvinylpyrrolidone; and sodium alginate, polyethyleneimine, polypropylene glycol, polyethylene glycol, maleic acid anhydride and copolymers thereof. The binders of the present invention are not limited to the above compounds.

These water-dispersible binders and/or water-soluble binders may be used singly or as a mixture of two or more kinds. In particular, the use of a latex binder, which is a water-dispersible binder, in the coating layer provides excellent strength of the coating layer. It is therefore preferable that the coating layer of the present invention contain a latex binder as the main binder. As used herein, the phrase "contain a latex binder as the main binder" indicates that the latex binder in the coating layer represents 50 mass % or more, and preferably 60 mass % or more of the total content of the binder(s) in the coating layer.

From the viewpoints of the strength and the ink absorption properties of the coating layer, the total content of the binder(s) in the coating layer is preferably 5 parts by mass to 50 parts by mass, both inclusive, and more preferably 10 parts by mass to 30 parts by mass, both inclusive, with respect to 100 parts by mass of the total of the pigment(s) in the coating layer.

The coated printing paper of the present invention may be produced by applying the coating layer onto at least one surface of the base paper. In the present invention, the coating layer may be applied onto the base paper by any usual application method using any of various applicators such as blade coaters, roll coaters, air knife coaters, film transfer coaters, bar coaters, rod blade coaters, short dwell coaters and curtain coaters. The application method is not limited to such methods.

The coated printing paper finished with the coating layer(s) may be used as such. Alternatively, the surface of the coated printing paper finished with the coating layer(s) may be smoothened as required with a device such as a on-line machine calender, a soft nip calender, a super calender, a multistage calender or a multi-nip calender.

However, excessive calendering for smoothing collapses voids in the coated printing paper, and ink absorption properties exhibited during ink jet printing is deteriorated as a result. Thus, moderate calendering is preferable.

In the coated printing paper of the present invention, the coating layer is provided on at least one surface of the base paper. That is, the coating layers may be provided on both surfaces of the base paper. Such double-side coating is preferable because images can be printed on both surfaces depending on the type of a printing machine. In the second aspect of the present invention, when double-side coating is performed, it does not matter as long as at least one of the coating layers contains ground calcium carbonate and the calcium compound other than calcium carbonate in the amounts according to the present invention.

In the present invention, an intermediate layer containing a pigment and a binder may be provided between the coating layer and the base paper in accordance with, for example, the need of controlling smoothness or ink absorption properties. The pigment and the binder used in the intermediate layer may be appropriately selected from the pigments and the binders which may be used in the coating layer.

The final coated printing paper is fabricated into sheet products or roll products of various sizes in accordance with applications. When such products are stored, it is preferable to give them moisture proof wrapping to prevent the absorption of moisture. The basis weight of the coated printing paper is not particularly limited, but is preferably 40 $g/m^2$ to 300 $g/m^2$, both inclusive.

The coated printing paper of the present invention may be used for offset printing as well as for ink jet printing, and allows images printed thereon to exhibit excellent image quality and durability. The coated printing paper of the present invention may be suitably used for printing with an ink jet printing machine using pigment inks, and allows images printed thereon to exhibit excellent image quality and durability. The coated printing paper of the present invention may be suitably used for printing with a rotary ink jet printing machine having a printing speed of 15 m/min or more, a higher speed of 60 m/min or more, and a still higher speed in excess of 120 m/min, and allows images printed thereon to exhibit excellent image quality and durability.

The coated printing paper of the present invention may be used not only for offset printing but also for other types of printing such as gravure printing and liquid or dry electrophotography without limitation. Further, the coated printing paper may be used for rotary or sheetfed ink jet printing machines as well as for printers such as commercially available ink jet printers.

In the present invention, the third aspect is directed to a method for forming printed images which includes ink jet printing using a pigment ink on the coating layer of the above-described coated printing paper at a printing speed of 15 m/min or more. According to the method of the present invention, printed images can be formed without the occurrence of uneven printing even when pigment inks are used for ink jet printing at a printing speed of 15 m/min or more, a higher speed of 60 m/min or more, and a still higher speed of 120 m/min. The fourth aspect of the present invention is directed to a method for forming printed images on the coating layer of the above-described coated printing paper using an offset printing machine and/or an ink jet printing machine. According to this method, excellent printed images can be formed using an offset printing machine and/or an ink jet printing machine.

In the first to fourth aspects of the present invention, configurations, effects and contents which are similar to those described with respect to the first aspect are not described anew each time where appropriate.

EXAMPLES

Hereinbelow, the present invention will be described in greater detail by presenting Examples. However, the present invention is not limited to such Examples and may be modified within the scope of the present invention. In Examples, "part(s)" and "%" refer to part(s) by mass and mass %, respectively, of dry solids or substantial components except for the glossiness values. The coating weight indicates the coating weight on a dry solid basis.

(Production of Base Paper)

⟨Production of Base Paper 1⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 3.0 g/m$^2$, respectively, in terms of the amount of solids attached onto both surfaces of the paper. The paper was then subjected to on-line machine calendering to give base paper 1 having a basis weight of 100 g/m$^2$. The ash content in the base paper was 13.0%.

⟨Production of Base Paper 2⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 0.6 g/m$^2$, respectively, in terms of the amount of solids attached onto both surfaces of the paper. The paper was then subjected to on-line machine calendering to give base paper 2 having a basis weight of 100 g/m$^2$. The ash content in the base paper was 10.6%.

⟨Production of Base Paper 3⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 0.9 g/m$^2$, respectively, in terms of the amount of solids attached onto both surfaces of the paper. The paper was then subjected to on-line machine calendering to give base paper 3 having a basis weight of 100 g/m$^2$. The ash content in the base paper was 10.9%.

⟨Production of Base Paper 4⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 6.4 g/m$^2$, respectively, in terms of the amount of solids attached onto both surfaces of the paper. The paper was then subjected to on-line machine calendering to give base paper 4 having a basis weight of 100 g/m$^2$. The ash content in the base paper was 16.4%.

⟨Production of Base Paper 5⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium nitrate were attached to the paper in amounts of 3.0 g/m$^2$ and 3.0 g/m$^2$, respectively, in terms of the amount of solids attached onto both surfaces of the paper. The paper was then subjected to on-line machine calendering to give base paper 5 having a basis weight of 100 g/m$^2$. The ash content in the base paper was 13.0%.

⟨Production of Base Paper 6⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 0.2 g/m$^2$, respectively, in terms of the amount of solids attached onto both surfaces of the paper. The paper was then subjected to on-line machine calendering to give base paper 6 having a basis weight of 100 g/m$^2$. The ash content in the base paper was 10.2%.

⟨Production of Base Paper 7⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 7.2 g/m$^2$, respectively, in terms of the amount of solids attached onto both surfaces of the paper. The paper was then subjected to on-line machine calendering to give base paper 7 having a basis weight of 100 g/m$^2$. The ash content in the base paper was 17.2%.

⟨Production of Base Paper 8⟩

To a pulp slurry which contained 100 parts of LBKP having a freeness of 400 mlcsf were added 12 parts of kaolin as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and calcium chloride were attached to the paper in amounts of 3.0 g/m$^2$ and 3.0 g/m$^2$, respectively, in terms of the amount of solids attached onto both surfaces of the paper. The paper was then subjected to on-line machine calendering to give base paper 8 having a basis weight of 100 g/m$^2$. The ash content in the base paper was 13.0%.

⟨Production of Base Paper 9⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and magnesium chloride were attached to the paper in amounts of 3.0 g/m$^2$ and 3.0 g/m$^2$, respectively, in terms of the amount of solids attached onto both surfaces of the paper. The paper was then subjected to on-line machine calendering to give base paper 9 having a basis weight of 100 g/m$^2$. The ash content in the base paper was 13.0%.

⟨Production of Base Paper 10⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate and dimethylamine-epichlorohydrin polycondensate (JET FIX 36N, manufactured by Satoda Chemical Industrial Co., Ltd.) were attached to the paper in amounts of 3.0 g/m$^2$ and 3.0 g/m$^2$, respectively, in terms of the amount of solids attached onto both surfaces of the paper. The paper was then subjected to on-line machine calendering to give base paper 10 having a basis weight of 100 g/m$^2$. The ash content in the base paper was 10.0%.

⟨Production of Base Paper 11⟩

To a pulp slurry which contained 100 parts of LBKP having a freeness of 400 mlcsf were added 12 parts of precipitated calcium carbonate as a filler, 0.8 parts of amphoteric starch, 0.8 parts of aluminum sulfate and 1.0 part of an alkyl ketene dimer sizing agent (Sizepine K903, manufactured by Arakawa Chemical Industries, Ltd.). The resultant paper stock was made into paper with a Fourdrinier machine. With a size press, starch phosphate was attached to the paper in an amount of 3.0 g/m$^2$, in terms of the amount of solids attached onto both surfaces of the paper. The paper was then subjected to on-line machine calendering to give base paper 11 having a basis weight of 100 g/m$^2$. The ash content in the base paper was 10.0%.

⟨Production of Base Paper 12⟩

Base paper 12 was produced in the same manner as base paper 11, except that 4 parts of precipitated calcium carbonate and 8 parts of kaolin were used as the fillers. The ash content in the base paper was 10%.

⟨Production of Base Paper 13⟩

Base paper 13 was produced in the same manner as base paper 11, except that 12 parts of kaolin was used as the filler. The ash content in the base paper was 10%.

Coated printing papers were produced in the following manner in Examples 1 to 14 and Comparative Examples 1 to 9.

⟨Preparation of Coating Colour for Formation of Coating Layer⟩

A coating colour for a coating layer was prepared from the following materials.

Pigments added parts are shown in Table 1

Binders added parts are shown in Table 1

The above materials were blended and mixed together with water to give an aqueous dispersion having a solid concentration of 60%.

⟨Production Of Coated Printing Paper⟩

The coating colour was applied onto both surfaces of the base paper using a blade coater. After the coating colour was dried, the paper was subjected to calendering to give coated printing paper. The calender used herein was a device having an elastic roll and a metal roll. Two levels of nip pressure were adopted while ensuring that an appropriate thickness profile in the width direction would be obtained. That is, a low nip pressure (80 kN/m) (Example 2 and Comparative Example 2) and a high nip pressure (180 kN/m) (Examples 1 and 3 to 14, and Comparative Examples 1 and 3 to 9) were employed. The temperature of the metal roll was 40° C. for the treatment at the low nip pressure and 180° C. for the treatment at the high nip pressure. The calendering conditions are described in Table 1.

The coating weights are shown as the coating weights per surface in Table 1.

TABLE 1

| | Base paper | | | Coating layer | | | | | | | | | | | |
|---|---|---|---|---|---|---|---|---|---|---|---|---|---|---|---|
| | | | | Pigments | | | | | Binders | | | | | | |
| | | Filler | Calcium compound other than calcium carbonate | a1 Parts | b Parts | c Parts | d Parts | e Parts | f Parts | g Parts | Coating weight per surface g/m$^2$ | Ca content in base paper mmol | A/B | Calendering conditions |
| Example 1 | Base paper 1 | Precipitated calcium carbonate | Calcium chloride | 90 | | 10 | | | 8 | 2 | 15 | 27 | 13 | High |

TABLE 1-continued

| | Base paper | | | Coating layer | | | | | | | | | | |
|---|---|---|---|---|---|---|---|---|---|---|---|---|---|---|
| | | | | Pigments | | | | | Binders | | | | | |
| | | Filler | Calcium compound other than calcium carbonate | a1 Parts | b Parts | c Parts | d Parts | e Parts | f Parts | g Parts | Coating weight per surface g/m$^2$ | Ca content in base paper mmol | A/B | Calendering conditions |
| Example 2 | Base paper 1 | Precipitated calcium carbonate | Calcium chloride | 90 | | 10 | | | 8 | 2 | 15 | 27 | 13 | Low |
| Example 3 | Base paper 1 | Precipitated calcium carbonate | Calcium chloride | 100 | | | | | 8 | 2 | 15 | 27 | 14 | High |
| Example 4 | Base paper 1 | Precipitated calcium carbonate | Calcium chloride | 90 | | | | 10 | 8 | 2 | 15 | 27 | 13 | High |
| Example 5 | Base paper 1 | Precipitated calcium carbonate | Calcium chloride | 90 | 10 | | | | 8 | 2 | 15 | 27 | 14 | High |
| Example 6 | Base paper 1 | Precipitated calcium carbonate | Calcium chloride | 90 | | | 10 | | 8 | 2 | 15 | 27 | 13 | High |
| Example 7 | Base paper 1 | Precipitated calcium carbonate | Calcium chloride | 60 | | 40 | | | 8 | 2 | 15 | 27 | 10 | High |
| Example 8 | Base paper 2 | Precipitated calcium carbonate | Calcium chloride | 90 | | 10 | | | 8 | 2 | 15 | 5.4 | 64 | High |
| Example 9 | Base paper 3 | Precipitated calcium carbonate | Calcium chloride | 90 | | 10 | | | 8 | 2 | 15 | 8.1 | 43 | High |
| Example 10 | Base paper 4 | Precipitated calcium carbonate | Calcium chloride | 90 | | 10 | | | 8 | 2 | 15 | 58 | 6.0 | High |
| Example 11 | Base paper 1 | Precipitated calcium carbonate | Calcium chloride | 90 | | 10 | | | 8 | 2 | 6 | 27 | 7.3 | High |
| Example 12 | Base paper 1 | Precipitated calcium carbonate | Calcium chloride | 90 | | 10 | | | 8 | 2 | 27 | 27 | 20 | High |
| Example 13 | Base paper 5 | Precipitated calcium carbonate | Calcium nitrate | 90 | | 10 | | | 8 | 2 | 15 | 18 | 19 | High |
| Example 14 | Base paper 4 | Precipitated calcium carbonate | Calcium chloride | 50 | | 50 | | | 8 | 2 | 6 | 58 | 2.7 | High |
| Comparative example 1 | Base paper 1 | Precipitated calcium carbonate | Calcium chloride | 40 | | 60 | | | 8 | 2 | 15 | 27 | 7.7 | High |
| Comparative example 2 | Base paper 1 | Precipitated calcium carbonate | Calcium chloride | 40 | | 60 | | | 8 | 2 | 15 | 27 | 7.7 | Low |
| Comparative example 3 | Base paper 1 | Precipitated calcium carbonate | Calcium chloride | | 90 | 10 | | | 8 | 2 | 15 | 27 | 13 | High |
| Comparative example 4 | Base paper 6 | Precipitated calcium carbonate | Calcium chloride | 90 | | 10 | | | 8 | 2 | 15 | 1.8 | 192 | High |
| Comparative example 5 | Base paper 7 | Precipitated calcium carbonate | Calcium chloride | 90 | | 10 | | | 8 | 2 | 15 | 65 | 5.3 | High |
| Comparative example 6 | Base paper 8 | Kaolin | Calcium chloride | 90 | | 10 | | | 8 | 2 | 15 | 27 | 9.1 | High |
| Comparative example 7 | Base paper 9 | Precipitated calcium carbonate | Magnesium chloride | 90 | | 10 | | | 8 | 2 | 15 | 0 | — | High |
| Comparative example 8 | Base paper 10 | Precipitated calcium carbonate | Dimethylamine-epichlorohydrin polycondensate | 90 | | 10 | | | 8 | 2 | 15 | 0 | — | High |
| Comparative example 9 | Base paper 11 | Precipitated calcium carbonate | None | 90 | | 10 | | | 8 | 2 | 15 | 0 | — | High |

The pigments and the binders indicated with codes in Table 1 are the following.

(Pigments)

a1: ground calcium carbonate (SETACARB-HG, manufactured by BIHOKU FUNKA KOGYO CO., LTD.)

b: precipitated calcium carbonate (TP 123, manufactured by OKUTAMA KOGYO CO., LTD.)

c: kaolin (UW 90, manufactured by ENGELHARD)

d: synthetic amorphous silica (P 705, manufactured by TOSOH SILICA CORPORATION)

e: styrene-acrylic plastic pigment (ROPAQUE HP 91, manufactured by Rohm and Haas Company)

(Binders)

f: styrene-butadiene copolymer latex (JSR-2605G, manufactured by JSR CORPORATION)

g: polyvinyl alcohol (PVA 105, manufactured by KURARAY CO., LTD.)

The "Ca content in base paper" in Table 1 indicates the content of calcium derived from the calcium compound according to the present invention, and is in detail the calcium content in terms of calcium ions derived from the calcium compound other than calcium carbonate per 1 m$^2$ of the base paper. The ratio "A/B" in Table 1 is the molar ratio (A/B) of the calcium content A in terms of calcium ions derived from calcium carbonate to the calcium content B in terms of calcium ions derived from the calcium compound other than calcium carbonate per 1 m$^2$ of the coated printing paper.

The calcium content A (mmol) is calculated based on the mass (g) of calcium carbonate present in 1 m$^2$ of the coated printing paper composed of the base paper and the coating layers. The mass (g) of calcium carbonate present in the base paper is a difference from the subtraction of the mass (g) of the calcium compound other than calcium carbonate or any other water-soluble multivalent metal salt from the mass of ash of the base paper (g, a product of the basis weight of the base paper multiplied by the ash content [%]). The mass (g) of calcium carbonate present in the coating layers is calculated based on the formulation by multiplying the value of (a1+b)/(a1+b+c+d+e+f+g) by the coating weight per surface, and doubling the product when the paper was double-side coated. The calcium content A (mmol) is calculated by combining the masses (g) of calcium carbonate present in the base paper and in the coating layers, dividing the sum by the molecular weight of calcium carbonate which is 100, and multiplying the quotient by 1000. The calcium content B (mmol) is calculated by dividing the mass (g) of the calcium compound other than calcium carbonate present in 1 $m^2$ of the base paper by the molecular weight of the calcium compound (in this case, 110 for calcium chloride and 164 for calcium nitrate), and multiplying the quotient by 1000.

⟨Evaluation of Coated Printing Paper⟩

The coated printing papers from Examples 1 to 14 and Comparative Examples 1 to 9 were tested by the following methods to evaluate glossiness, offset printability, ink absorption properties, ink fixing properties and the occurrence of uneven printing. The results are shown in Table 2.

The properties except offset printability were evaluated using an ink jet printing machine. Versamark VL2000 manufactured by Eastman Kodak Company. was used as the ink jet printing machine. Pigment inks were used as the inks. Printing was performed at a printing transport speed of 75 m per minute.

(Evaluation of Sheet Gloss)

The sheet gloss of the coated printing paper was measured in accordance with JIS Z8741 at an incidence and reflection angle of 75° using digital gloss meter GM-26D manufactured by Murakami Color Research Laboratory. A glossiness of 40% or less is satisfactory for use as matte coated printing paper. A glossiness of 50% or more is satisfactory for use as glossy coated printing paper. A glossiness of 60% to 90% is satisfactory for use as highly glossy coated printing paper.

(Evaluation of Offset Printability)

Images were printed over a length of 6000 m with an offset form rotary press manufactured by Miyakoshi Printing Machinery Co., Ltd. under conditions where the printing speed was 150 m/min, the inks used were T&K TOKA UV BEST CURE black and bronze red, and UV radiation value: 8 kW×2 irradiators. After printing, the occurrence of blanket piling and the quality of the print sample were visually inspected and evaluated. Practical use is possible without any problems when the print is graded 3 to 5.

5: Very good

4: Good

3: Practically usable

2: Bad

1: Very bad (Evaluation of Ink Absorption Property)

Solid printing was performed on the coated printing paper using the printing machine in such a manner that 2 cm×2 cm square solid patterns were recorded in a single continuous row with seven colors, namely, black, cyan, magenta, yellow and superimposed colors (red, green, blue) created by a combination of two colors out of the above three color inks except the black ink. The printed section was visually inspected to evaluate the solid color portions and the boundaries. Practical use is possible without any problems when the print is graded 3 to 5.

5: The boundaries between colors were free from bleeding.

4: The boundaries between colors were substantially free from bleeding.

3: A boundary between colors had become blurred but was still clearly recognizable.

2: A boundary between colors was unclear, and adjacent colors had bled slightly across the boundary.

1: Each of the boundaries between colors was indistinct, and colors had bled to adjacent colors markedly.

(Evaluation of Ink Fixing Properties)

The coated printing paper was ejected through the delivery section of the printing machine at a predetermined transport speed. The printed surface was observed to visually evaluate the degree of smudges of the ink. Practical use is possible without any problems when the print is graded 3 to 5.

5: No smudges of the ink were found.

4: Substantially no smudges of the ink were found.

3: Slight smudges of the ink were found.

2: Smudges of the ink were found, and the print looked smeared locally.

1: Smudges of the ink were found in the entirety of the printed section.

(Evaluation of Uneven Printing)

Solid printing was performed on the coated printing paper using the printing machine in such a manner that 3 cm×3 cm square solid patterns were recorded in a single continuous row with seven colors, namely, black, cyan, magenta, yellow and superimposed colors (red, green, blue) created by a combination of two colors out of the above three color inks except the black ink. The printed section was visually inspected to evaluate the unevenness in print density of each of the solid color portions. Practical use is possible without any problems when the print is graded 3 to 5.

5: Any unevenness in print density was not found.

4: Very slight unevenness in print density was found for one or more colors.

3: Slight unevenness in print density was found.

2: Unevenness in print density was found locally.

1: Unevenness in print density was found in the entirety of the printed section.

Table 2 shows the results of the evaluations of printing on the coated printing papers in Examples 1 to 14 and Comparative Examples 1 to 9.

TABLE 2

| | Evaluation results | | | | |
|---|---|---|---|---|---|
| | Sheet | Ink jet printing machine | | | |
| | gloss 75° % | Offset print-ability | Ink absorption properties | Ink fixing properties | Uneven printing |
| Example 1 | 74 | 4 | 4 | 5 | 4 |
| Example 2 | 32 | 4 | 5 | 5 | 4 |
| Example 3 | 70 | 5 | 5 | 5 | 4 |
| Example 4 | 78 | 4 | 4 | 4 | 4 |
| Example 5 | 71 | 5 | 4 | 5 | 4 |
| Example 6 | 69 | 3 | 5 | 5 | 5 |
| Example 7 | 79 | 3 | 3 | 4 | 3 |
| Example 8 | 72 | 4 | 3 | 3 | 3 |
| Example 9 | 72 | 4 | 3 | 4 | 3 |
| Example 10 | 76 | 3 | 5 | 5 | 3 |
| Example 11 | 70 | 5 | 4 | 4 | 4 |
| Example 12 | 79 | 3 | 3 | 4 | 3 |
| Example 13 | 73 | 4 | 4 | 4 | 4 |
| Example 14 | 79 | 3 | 3 | 4 | 3 |
| Comparative example 1 | 81 | 3 | 3 | 3 | 1 |
| Comparative example 2 | 38 | 3 | 3 | 3 | 1 |
| Comparative example 3 | 73 | 4 | 3 | 3 | 2 |
| Comparative example 4 | 71 | 4 | 3 | 3 | 2 |
| Comparative example 5 | 76 | 3 | 5 | 5 | 2 |
| Comparative example 6 | 76 | 3 | 3 | 3 | 2 |
| Comparative example 7 | 72 | 4 | 4 | 4 | 2 |
| Comparative example 8 | 73 | 4 | 4 | 5 | 2 |
| Comparative example 9 | 72 | 4 | 1 | 1 | 1 |

From Table 2, it has been illustrated that excellent offset printability, ink absorption properties and ink fixing properties can be obtained and the occurrence of uneven printing in printed sections can be suppressed according to the coated printing papers of Examples 1 to 14 which include the base paper and the coating layer containing pigments and binders as main components on at least one surface of the base paper. In these coated printing papers, the base paper contains calcium carbonate, the coating layer contains ground calcium carbonate as a pigment in an amount of 50 parts by mass or more relative to 100 parts by mass of the total of the pigment(s) in the coating layer, the base paper contains a calcium compound other than calcium carbonate, and the content of calcium derived from the calcium compound is 3 mmol to 60 mmol, both inclusive, in terms of calcium ions per 1 $m^2$ of the base paper. The comparison between Example 1 and Example 13 shows that calcium chloride is preferred.

On the other hand, Table 2 shows that Comparative Examples 1 to 9 which did not satisfy the conditions according to the present invention failed to achieve the advantageous effects of the present invention. In particular, it has been demonstrated that uneven printing occurred.

Coated printing papers were produced in the following manner in Examples 15 to 36 and Comparative Examples 10 to 17.

⟨Preparation of Coating Colour for Formation of Coating Layer⟩

A coating colour for a coating layer was prepared from the following materials.

Pigments added parts are shown in Table 3

Binders added parts are shown in Table 3

Calcium compounds added parts are shown in Table 3

Cationic agents (except calcium compounds)

added parts are shown in Table 3

The above materials were blended and mixed together with water to give an aqueous dispersion having a solid concentration of 30%.

⟨Production of Coated Printing Paper⟩

The coating colour was applied onto both surfaces of the base paper using an air knife coater. After the coating colour was dried, the paper was subjected to calendering to give coated printing paper. The types of base paper used are shown in Table 3.

The coating weights are shown as the coating weights per surface in Table 3.

TABLE 3

| | | Coating layer | | | | | | | | | | | | |
|---|---|---|---|---|---|---|---|---|---|---|---|---|---|---|
| | | Pigments | | | | Binders | | Calcium compounds | | Cationic agents | | Coating weight per | Ca content in | |
| | Base paper | a2 Parts | b Parts | c Parts | d Parts | g Parts | h Parts | i Parts | j Parts | k Parts | l Parts | surface g/$m^2$ | coating layer mmol | A/B |
| Example 15 | Base paper 11 | 50 | | 50 | | 5 | 10 | 3 | | | | 14 | 3 | 34.1 |
| Example 16 | Base paper 11 | 50 | | 50 | | 5 | 10 | 9 | | | | 15 | 10 | 11.3 |
| Example 17 | Base paper 11 | 50 | | 50 | | 5 | 10 | 67 | | | | 18 | 60 | 1.7 |
| Example 18 | Base paper 11 | 60 | | 40 | | 5 | 10 | 9 | | | | 15 | 10 | 12.5 |
| Example 19 | Base paper 11 | 100 | | | | 5 | 10 | 9 | | | | 15 | 10 | 17.4 |
| Example 20 | Base paper 11 | 50 | | 50 | | 5 | 10 | | 5 | | | 13 | 3 | 31.5 |
| Example 21 | Base paper 11 | 50 | | 50 | | 5 | 10 | | 15 | | | 14 | 10 | 10.5 |
| Example 22 | Base paper 11 | 50 | | 50 | | 5 | 10 | | 92 | | | 22 | 60 | 1.7 |
| Example 23 | Base paper 11 | 50 | 50 | | | 5 | 10 | 10 | | | | 14 | 10 | 16.1 |
| Example 24 | Base paper 11 | 50 | | | 50 | 5 | 10 | 10 | | | | 14 | 10 | 10.5 |
| Example 25 | Base paper 12 | 50 | | 50 | | 5 | 10 | 112 | | | | 9 | 40 | 0.9 |
| Example 26 | Base paper 12 | 50 | | 50 | | 5 | 10 | 78 | | | | 11 | 40 | 1.1 |
| Example 27 | Base paper 11 | 50 | | 50 | | 5 | 10 | 112 | | | | 9 | 40 | 1.7 |
| Example 28 | Base paper 12 | 60 | | 40 | | 5 | 10 | 3 | | | | 14 | 3 | 27.4 |
| Example 29 | Base paper 12 | 85 | | 15 | | 5 | 10 | 3 | | | | 14 | 3 | 36.6 |
| Example 30 | Base paper 12 | 100 | | | | 5 | 10 | 3 | | | | 14 | 3 | 42.2 |
| Example 31 | Base paper 11 | 100 | | | | 5 | 10 | 3 | | | | 14 | 3 | 52.6 |
| Example 32 | Base paper 11 | 50 | | 50 | | 8 | 7 | 10 | | | | 14 | 10 | 7.2 |
| Example 33 | Base paper 11 | 50 | | 50 | | 3 | 6 | 9 | | | | 14 | 10 | 11.4 |
| Example 34 | Base paper 11 | 50 | | 50 | | 15 | 30 | 13 | | | | 14 | 10 | 9.1 |
| Example 35 | Base paper 11 | 50 | | 50 | | 5 | 10 | 143 | | | | 2 | 10 | 5.4 |

TABLE 3-continued

| | | Coating layer | | | | | | | | | | | | |
|---|---|---|---|---|---|---|---|---|---|---|---|---|---|---|
| | | Pigments | | | | Binders | | Calcium compounds | | Cationic agents | | Coating weight per | Ca content in | |
| | Base paper | a2 Parts | b Parts | c Parts | d Parts | g Parts | h Parts | i Parts | j Parts | k Parts | l Parts | surface g/m$^2$ | coating layer mmol | A/B |
| Example 36 | Base paper 11 | 50 | | 50 | | 5 | 10 | 5 | | | | 25 | 9 | 16.4 |
| Comparative example 10 | Base paper 11 | 50 | | 50 | | 5 | 10 | 2 | | | | 13 | 2 | 52.7 |
| Comparative example 11 | Base paper 11 | 50 | | 50 | | 5 | 10 | 65 | | | | 20 | 65 | 1.6 |
| Comparative example 12 | Base paper 11 | 45 | | 55 | | 5 | 10 | 10 | | | | 14 | 10 | 10 |
| Comparative example 13 | Base paper 11 | 45 | | | 55 | 5 | 10 | 10 | | | | 14 | 10 | 10 |
| Comparative example 14 | Base paper 11 | 50 | | 50 | | 5 | 10 | | | | | 14 | 0 | — |
| Comparative example 15 | Base paper 11 | 50 | | 50 | | 5 | 10 | | | 10 | | 14 | 0 | — |
| Comparative example 16 | Base paper 11 | 50 | | 50 | | 5 | 10 | | | | 10 | 14 | 0 | — |
| Comparative example 17 | Base paper 13 | 50 | | 50 | | 5 | 10 | 10 | | | | 14 | 10 | 5.6 |

The pigments, the binders, the calcium compounds and the cationic agents (except calcium compounds) indicated with codes in Table 3 are the following.

(Pigments)

a2: ground calcium carbonate (SETACARB, manufactured by SHIRAISHI CALCIUM KAISHA, LTD.)

b: precipitated calcium carbonate (TP 123, manufactured by OKUTAMA KOGYO CO., LTD.)

c: kaolin (UW 90, manufactured by ENGELHARD)

d: synthetic amorphous silica (P 705, manufactured by TOSOH SILICA CORPORATION)

(Binders)

g: polyvinyl alcohol (PVA 105, manufactured by KURARAY CO., LTD.)

h: ethylene-vinyl acetate resin (RIKABOND BEF 9857, manufactured by CSC Co., Ltd.)

(Calcium Compounds)

i: calcium chloride j: calcium nitrate (Cationic Agents)

k: magnesium chloride l: cationic resin (PAPYOGEN P 105, manufactured by SENKA CORPORATION)

The "Ca content in coating layer" in Table 3 indicates the content of calcium derived from the calcium compound according to the present invention, and is in detail the calcium content in terms of calcium ions derived from the calcium compound other than calcium carbonate per 1 m$^2$ of the coating layer on one surface of the coated printing paper. The ratio "A/B" in Table 3 is the molar ratio (A/B) of the calcium content A in terms of calcium ions derived from calcium carbonate to the calcium content B in terms of calcium ions derived from the calcium compound other than calcium carbonate per 1 m$^2$ of the coated printing paper.

The calcium content A (mmol) is calculated based on the mass (g) of calcium carbonate present in 1 m$^2$ of the coated printing paper composed of the base paper and the coating layers. The mass (g) of calcium carbonate present in the base paper is a product of the mass of ash of the base paper (g, a product of the basis weight of the base paper multiplied by the ash content [%]) multiplied by the ratio of fillers (in this case, precipitated calciumu carbonate/(precipitated calciumu carbonate+kaolin)). The mass (g) of calcium carbonate present in the coating layers is calculated based on the formulation by multiplying the value of (a2+b)/(a2+b+c+d+g+h+i+j+k+l) by the coating weight per surface, and doubling the product when the paper was double-side coated. The calcium content A (mmol) is calculated by combining the masses (g) of calcium carbonate present in the base paper and in the coating layers, dividing the sum by the molecular weight of calcium carbonate which is 100, and multiplying the quotient by 1000. The calcium content B (mmol) is calculated based on the formulation by multiplying each of the value of i/(a2+b+c+d+g+h+i+j+k+l) and the value of j/(a2+b+c+d+g+h+i+j+k+l) by the coating weight per surface, doubling the each product when the paper was double-side coated, dividing each of the products by the molecular weight of the respective calcium compounds (i and j) (in this case, 110 for calcium chloride and 164 for calcium nitrate), multiplying both quotients by 1000, and summing the products.

⟨Evaluation of Coated Printing Paper⟩

The coated printing papers from Examples 15 to 36 and Comparative Examples 10 to 17 were tested by the aforementioned methods to evaluate offset printability, ink absorption properties, ink fixing properties and the occurrence of uneven printing in printed sections. The results are shown in Table 4.

TABLE 4

| | Evaluation results | | | |
|---|---|---|---|---|
| | | Ink jet printing machine | | |
| | Offset printability | Ink absorption properties | Ink fixing properties | Uneven printing |
| Example 15 | 4 | 3 | 3 | 4 |
| Example 16 | 4 | 4 | 4 | 4 |
| Example 17 | 4 | 3 | 4 | 3 |
| Example 18 | 5 | 5 | 5 | 5 |
| Example 19 | 5 | 4 | 4 | 4 |
| Example 20 | 4 | 3 | 3 | 3 |
| Example 21 | 4 | 4 | 4 | 3 |

TABLE 4-continued

| | Evaluation results | | | |
|---|---|---|---|---|
| | | Ink jet printing machine | | |
| | Offset printability | Ink absorption properties | Ink fixing properties | Uneven printing |
| Example 22 | 4 | 4 | 4 | 3 |
| Example 23 | 4 | 4 | 4 | 4 |
| Example 24 | 3 | 5 | 5 | 5 |
| Example 25 | 3 | 3 | 3 | 3 |
| Example 26 | 3 | 4 | 4 | 4 |
| Example 27 | 4 | 4 | 4 | 4 |
| Example 28 | 4 | 4 | 4 | 4 |
| Example 29 | 4 | 3 | 3 | 4 |
| Example 30 | 4 | 3 | 3 | 4 |
| Example 31 | 5 | 3 | 3 | 3 |
| Example 32 | 4 | 3 | 3 | 4 |
| Example 33 | 3 | 4 | 4 | 4 |
| Example 34 | 5 | 3 | 4 | 4 |
| Example 35 | 4 | 4 | 4 | 4 |
| Example 36 | 4 | 4 | 4 | 4 |
| Comparative example 10 | 4 | 3 | 2 | 2 |
| Comparative example 11 | 4 | 2 | 4 | 3 |
| Comparative example 12 | 3 | 3 | 2 | 2 |
| Comparative example 13 | 2 | 5 | 5 | 3 |
| Comparative example 14 | 4 | 1 | 1 | 1 |
| Comparative example 15 | 4 | 3 | 2 | 2 |
| Comparative example 16 | 4 | 3 | 2 | 2 |
| Comparative example 17 | 2 | 3 | 3 | 2 |

The properties except offset printability were evaluated using an ink jet printing machine. Versamark VL2000 manufactured by Eastman Kodak Company. was used as the ink jet printing machine. Pigment inks were used as the inks. Printing was performed at a printing transport speed of 75 m per minute.

From Table 4, it has been illustrated that excellent offset printability, ink absorption properties and ink fixing properties can be obtained and the occurrence of uneven printing in printed sections can be suppressed according to the coated printing papers of Examples 15 to 36 which include the base paper and the coating layer containing pigments and binders as main components on at least one surface of the base paper. In these coated printing papers, the base paper contains calcium carbonate, the coating layer contains ground calcium carbonate as a pigment in an amount of 50 parts by mass or more relative to 100 parts by mass of the total of the pigment(s) in the coating layer, the coating layer contains a calcium compound other than calcium carbonate, and the content of calcium derived from the calcium compound is 3 mmol to 60 mmol, both inclusive, in terms of calcium ions per 1 $m^2$ of the coating layer. The comparison between Examples 15 to 17 and Examples 20 to 22 shows that calcium chloride is preferred.

On the other hand, Table 4 shows that Comparative Examples 10 to 17 which did not satisfy the conditions according to the present invention failed to achieve the advantageous effects of the present invention.

The invention claimed is:

1. Coated printing paper comprising base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the base paper and/or the coating layer contains a calcium compound other than calcium carbonate, and the content of calcium derived from the calcium compound is 3 mmol to 60 mmol, both inclusive, in terms of calcium ions per 1 $m^2$ of the base paper and/or the coating layer.

2. The coated printing paper according to claim 1, which comprises base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the base paper contains a calcium compound other than calcium carbonate, and the content of calcium derived from the calcium compound is 3 mmol to 60 mmol, both inclusive, in terms of calcium ions per 1 $m^2$ of the base paper.

3. The coated printing paper according to claim 1, which comprises base paper and on at least one surface of the base paper, a coating layer containing a pigment and a binder as main components, wherein the base paper contains calcium carbonate, the coating layer contains ground calcium carbonate as a pigment in an amount of 50 parts by mass or more relative to 100 parts by mass of the total of the pigment(s) in the coating layer, the coating layer contains a calcium compound other than calcium carbonate, and the content of calcium derived from the calcium compound is 3 mmol to 60 mmol, both inclusive, in terms of calcium ions per 1 $m^2$ of the coating layer.

4. The coated printing paper according to claim 1, wherein the molar ratio (A/B) is 1 to 50, both inclusive, wherein A is the calcium content A derived from the calcium carbonate and B is the calcium content B derived from the calcium compound both in terms of calcium ions per 1 $m^2$ of the coated printing paper.

5. The coated printing paper according to claim 1, wherein the calcium compound is calcium chloride.

6. A method for forming printed images, comprising ink jet printing using a pigment ink on the coating layer of the coated printing paper as set forth in claim 1 at a printing speed of 15 m/min or more.

7. The coated printing paper according to claim 2, wherein the molar ratio (A/B) is 1 to 50, both inclusive, wherein A is the calcium content A derived from the calcium carbonate and B is the calcium content B derived from the calcium compound both in terms of calcium ions per 1 $m^2$ of the coated printing paper.

8. The coated printing paper according to claim 3, wherein the molar ratio (A/B) is 1 to 50, both inclusive, wherein A is the calcium content A derived from the calcium carbonate and B is the calcium content B derived from the calcium compound both in terms of calcium ions per 1 $m^2$ of the coated printing paper.

9. The coated printing paper according to claim 2, wherein the calcium compound is calcium chloride.

10. The coated printing paper according to claim 3, wherein the calcium compound is calcium chloride.

11. The coated printing paper according to claim 4, wherein the calcium compound is calcium chloride.

12. A method for forming printed images, comprising ink jet printing using a pigment ink on the coating layer of the coated printing paper as set forth in claim 2 at a printing speed of 15 m/min or more.

13. A method for forming printed images, comprising ink jet printing using a pigment ink on the coating layer of the coated printing paper as set forth in claim 3 at a printing speed of 15 m/min or more.

14. A method for forming printed images, comprising ink jet printing using a pigment ink on the coating layer of the coated printing paper as set forth in claim 4 at a printing speed of 15 m/min or more.

15. A method for forming printed images, comprising ink jet printing using a pigment ink on the coating layer of the coated printing paper as set forth in claim 5 at a printing speed of 15 m/min or more.

* * * * *